US008963661B2

(12) United States Patent
Despont et al.

(10) Patent No.: US 8,963,661 B2
(45) Date of Patent: Feb. 24, 2015

(54) FOUR TERMINAL NANO-ELECTROMECHANICAL SWITCH WITH A SINGLE MECHANICAL CONTACT

(71) Applicant: International Business Machines Corporation, Armonk, NY (US)

(72) Inventors: Michel Despont, Neuchâtel (CH); Ute Drechsler, Rueschlikon (CH); Daniel Grogg, Rueschlikon (CH); Christoph Hagleitner, Rueschlikon (CH); Yu Pu, Eindhoven (NL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/010,171

(22) Filed: Aug. 26, 2013

(65) Prior Publication Data

US 2014/0061013 A1 Mar. 6, 2014

(30) Foreign Application Priority Data

Aug. 31, 2012 (GB) ..... 1215512.3

(51) Int. Cl.
*H01H 51/22* (2006.01)
*H01H 49/00* (2006.01)
*H01H 59/00* (2006.01)

(52) U.S. Cl.
CPC ..... *H01H 49/00* (2013.01); *H01H 59/0009* (2013.01)
USPC ..... 335/78; 200/1 V

(58) Field of Classification Search
USPC ..... 335/78
See application file for complete search history.

(56) References Cited

U.S. PATENT DOCUMENTS

| | | | |
|---|---|---|---|
| 5,473,270 | A | 12/1995 | Denker |
| 5,477,164 | A | 12/1995 | Denker |
| 5,506,520 | A | 4/1996 | Frank et al. |
| 5,841,300 | A | 11/1998 | Murabayashi et al. |
| 6,009,021 | A | 12/1999 | Kioi |

(Continued)

FOREIGN PATENT DOCUMENTS

| | | | |
|---|---|---|---|
| JP | 2012028056 | A | 2/2012 |
| WO | 2007130913 | A2 | 11/2007 |
| WO | 2011109149 | A2 | 9/2011 |

OTHER PUBLICATIONS

International Search Report and Written Opinion; International Application No. PCT/IB2013/056276; International Filing Date: Jul. 31, 2013; Date of Mailing: Dec. 3, 2013, pp. 1-7.

(Continued)

*Primary Examiner* — Shawki S Ismail
*Assistant Examiner* — Lisa Homza
(74) *Attorney, Agent, or Firm* — Cantor Colburn LLP

(57) ABSTRACT

A nano-electro-mechanical switch includes an input electrode, a body electrode, an insulating layer, an actuator electrode, an output electrode, and a cantilever beam adapted to flex in response to an actuation voltage applied between the body electrode and the actuator electrode. The cantilever beam includes the input electrode, the body electrode and the insulating layer, the latter separating the body electrode from the input electrode, the cantilever beam being configured such that, upon flexion of the cantilever beam, the input electrode comes in contact with the output electrode at a single mechanical contact point at the level of an end of the cantilever beam.

2 Claims, 3 Drawing Sheets

(56) References Cited

U.S. PATENT DOCUMENTS

| | | | | |
|---|---|---|---|---|
| 6,046,659 | A * | 4/2000 | Loo et al. | 333/262 |
| 6,388,252 | B1 * | 5/2002 | Takahashi et al. | 850/7 |
| 6,548,841 | B2 | 4/2003 | Frazier et al. | |
| 6,770,558 | B2 * | 8/2004 | Delamarche et al. | 438/629 |
| 6,949,397 | B2 * | 9/2005 | Despont et al. | 438/52 |
| 7,566,939 | B2 * | 7/2009 | Despont et al. | 257/415 |
| 7,653,985 | B1 * | 2/2010 | Chang et al. | 29/622 |
| 7,719,318 | B1 | 5/2010 | Nordquist et al. | |
| 7,749,915 | B2 * | 7/2010 | Drechsler et al. | 438/725 |
| 8,018,308 | B2 | 9/2011 | Kwon et al. | |
| 8,258,899 | B2 | 9/2012 | Feng et al. | |
| 2003/0219970 | A1 * | 11/2003 | Delamarche et al. | 438/622 |
| 2004/0041594 | A1 | 3/2004 | Kang et al. | |
| 2004/0135219 | A1 * | 7/2004 | Despont et al. | 257/417 |
| 2005/0230839 | A1 * | 10/2005 | Despont et al. | 257/769 |
| 2009/0128221 | A1 | 5/2009 | Kam et al. | |
| 2009/0133914 | A1 * | 5/2009 | Dellmann et al. | 174/260 |
| 2010/0012471 | A1 | 1/2010 | Majumder et al. | |
| 2010/0090565 | A1 * | 4/2010 | Bhaskaran et al. | 310/330 |
| 2010/0140066 | A1 | 6/2010 | Feng et al. | |
| 2011/0002168 | A1 | 1/2011 | Schepens et al. | |
| 2011/0047785 | A1 * | 3/2011 | Biskeborn et al. | 29/603.07 |
| 2013/0127494 | A1 | 5/2013 | Liu et al. | |
| 2013/0146429 | A1 * | 6/2013 | Despont et al. | 200/181 |
| 2014/0059843 | A1 * | 3/2014 | Despont et al. | 29/622 |
| 2014/0087525 | A1 * | 3/2014 | Chen et al. | 438/154 |

OTHER PUBLICATIONS

Nathanael et al, "4-terminal relay technology for complementary logic," Proc. IEEE Int. Electron Devices Meeting (IEDM), 2009, pp. 223-226.

GB Intellectual Property Office; Application No. GB1215512.3; Patents Act 1977: Search Report under Section 17(5); Date Mailed: Dec. 11, 2012, pp. 1-3.

GB Intellectual Property Office; Application No. GB1215513.1; Patents Act 1977: Search Report Under Section 17(5); Date Mailed: Dec. 24, 2012; pp. 1-3.

A. Gupta, et al., "NEM Relay Memory Design," Technical Report No. UCB/EECS-2009-83, Electrical Engineering Computer Sciences, University of California at Berkeley, May 21, 2009, p. 1-1.

* cited by examiner

FOUR TERMINAL NANO-ELECTROMECHANICAL SWITCH WITH A SINGLE MECHANICAL CONTACT

PRIORITY

This application claims priority to Great Britain Patent Application No. 1215512.3, filed Aug. 31, 2012, and all the benefits accruing therefrom under 35 U.S.C. §119, the contents of which in its entirety are herein incorporated by reference.

BACKGROUND

The invention relates to the field of nano-electronics and is directed to a four terminal nano-electromechanical switch.

As power and energy constraints in microelectronic and nano-electronic applications become more and more challenging, one is seeking constantly alternative and more power efficient ways of switching and computing. A conventional switching device used in the semiconductor industry is a CMOS transistor. To overcome power related bottlenecks in CMOS devices, switching devices which operate on fundamentally different transport mechanisms such as tunneling are investigated. However, combining the desirable characteristics of high on-current, very low off-current, abrupt switching, high speed as well as a small footprint in a device that might be easily interfaced to a CMOS device is a challenging task. Mechanical switches such as nano-electromechanical switches (NEM switches) are promising devices to meet these kinds of criteria. A nano-electromechanical switch having a narrow gap between electrodes is controlled by electrostatic actuation. In response to an electrostatic force, a contact electrode can be bent to contact another electrode thus closing the switch. The control of the narrow gap for the electrostatic actuation and for the electrical contact separation is a main issue in designing and operating nano-electromechanical switches. A nano-electromechanical switch has to meet both, the requirement of high switching speed and low actuation voltage.

On the other hand, both three and four terminal switches are investigated, but four terminal switches offer more possibilities to circuit designers and are consequently investigated in priority. A four terminal switch indeed enables the control of the switching state (open/close) by a gate-to-body voltage independent of the source and the drain voltage. This is of great interest in many application scenarios, such as body-biasing schemes or for adiabatic logic.

Yet, four terminal switches described in the literature are bulky, with multiple large contact pads and poor scalability, like the ones described in Nathanael et Al., "4-terminal relay technology for complementary logic", Proc. IEEE Int. Electron Devices Meeting (IEDM), 2009.

The document U.S. Pat. No. 8,018,308 discloses a micro-electromechanical switch and a method for fabricating the same. From U.S. Pat. No. 8,018,308, it is known a downward type micro-electromechanical switch including a substrate in which a first cavity and a second cavity are formed. A first fixing line and a second fixing line are formed on an upper surface of the substrate not to be crossed with the first cavity and the second cavity. A contact pad is spaced apart at a predetermined distance from surfaces of the first fixing line and the second fixing line. A first actuator and a second actuator are disposed on each upper portion of the first cavity and the second cavity and downward actuate the contact pad to be in contact with at least one of the first fixing line and the second fixing line when power is supplied.

Within this context, there is still a need for an improved low power nano-electromechanical switch to reduce the power consumption in the switch, whereas the contact pad disclosed in prior art four terminal electromechanical switches are bulky and are sources of energy loss.

SUMMARY

In one embodiment, a nano-electro-mechanical switch includes an input electrode; a body electrode; an insulating layer; an actuator electrode; an output electrode; and a cantilever beam adapted to flex in response to an actuation voltage applied between the body electrode and the actuator electrode, wherein the cantilever beam comprises the input electrode, the body electrode and the insulating layer, the latter separating the body electrode from the input electrode, the cantilever beam being configured such that, upon flexion of the cantilever beam, the input electrode comes in contact with the output electrode at a single mechanical contact point at the level of an end of the cantilever beam.

In another embodiment, a method for fabricating a nano-electromechanical the method including forming an input electrode; forming a body electrode; forming an insulating layer; forming an actuator electrode; forming an output electrode; and forming a cantilever beam adapted to flex in response to an actuation voltage applied between the body electrode and the actuator electrode, wherein the cantilever beam comprises the input electrode, the body electrode and the insulating layer, the latter separating the body electrode from the input electrode, the cantilever beam being configured such that, upon flexion of the cantilever beam, the input electrode comes in contact with the output electrode at a single mechanical contact point at the level of an end of the cantilever beam.

BRIEF DESCRIPTION OF THE SEVERAL VIEWS OF THE DRAWINGS

Embodiments of the invention will now be described, by way of non-limiting examples, and in reference to the accompanying drawings, where.

DETAILED DESCRIPTION

Figure 1:
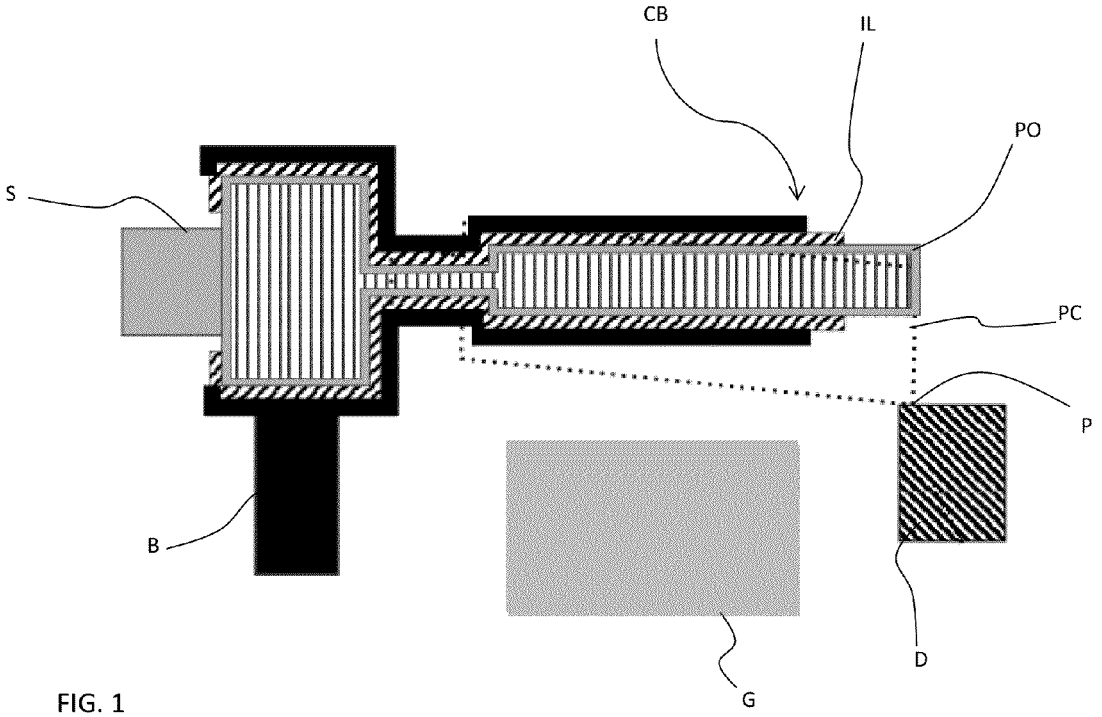
FIG. 1 shows an example of a nano-electromechanical switch according to an embodiment of the invention.

According to one aspect of the invention, a nano-electromechanical switch includes an actuator electrode, a body electrode, an input electrode, an output electrode, a cantilever beam adapted to flex in response to an actuation voltage applied between the body electrode and the gate electrode.

According to embodiments of the invention, the cantilever beam includes the input electrode, the body electrode and the insulating layer, the latter separating the body electrode from the input electrode, the cantilever beam being configured such that, upon flexion of the cantilever beam, the input electrode comes in contact with the output electrode at a single mechanical contact point at the level of an end of the cantilever beam.

According to one embodiment of the invention, the cantilever beam has a layer structure with at least three layers, including a first layer corresponding to the body electrode, a second layer corresponding to the isolating layer, and a third layer corresponding to the input electrode, wherein the three layers form a sequence wherein, on the one hand, the first layer is adjacent to the second layer, and on the other hand, the second layer is adjacent to the third layer.

In one embodiment of the invention, the cantilever beam is curved. Advantageously, the body electrode may comprise a lateral body conductive layer and the input electrode may comprise a lateral source conductive layer, the lateral source conductive layer being uncovered at the level of the end of the cantilever beam. Advantageously, a source current supplying the nano-electromechanical switch can be directly conducted through the material of the cantilever beam of the nano-electromechanical switch. Advantageously, the material of the cantilever beam may be doped silicon material.

Advantageously, the cantilever beam may further comprise a contact layer at the end of the cantilever beam, which may be metal or a low adhesion material. Advantageously, the nano-electromechanical switch being formed on a silicon on insulator wafer substrate, the input electrode may comprise a connection source plot placed on top of the nano-electromechanical switch with respect to the substrate, and the body electrode may comprise a lateral body conductive layer.

Embodiments of the invention further propose a method for fabricating a nano-electromechanical switch as disclosed hereabove, the method including: fabricating the cantilever beam, the latter comprising the input electrode, the body electrode and the insulating layer, where the isolating layer separates the body electrode from the input electrode, the cantilever beam being configured such that, upon flexion thereof, the input electrode can make contact with the output electrode at the single mechanical contact point at the level of the end of the cantilever beam.

The fabricating method may further comprise uncovering the end of the cantilever beam.

As an example, a method for fabricating a nano-electromechanical switch as disclosed hereabove may comprise the following: the etching, on a silicon on insulator wafer, of a silicon device layer; the deposition of a lateral source conductive layer, which may be obtained by the evaporation of Pt and rapid thermal annealing to create a PtSi layer on the silicon device layer, corresponding to a lateral source conductive layer; the deposition of an isolation layer; the deposition of a lateral body conductive layer; the removal of the isolation layer and of the lateral source and body conductive layers where not needed; the etching of the lateral body conductive layer and of the isolation layer at the their tip to uncover the lateral source conductive layer; the deposition of a sacrificial layer, in view of defining a gap; the deposition of a second sacrificial layer, in view of defining a mold for the gate and drain electrodes; the deposition of the electrode material to form the gate and drain electrodes; the removal of the excessive electrode material and of the mold, corresponding to the second sacrificial material; the final etching to release the cantilever beam.

According to the method, the mold sacrificial layer may be constituted of Cu or photo sensible resist.

According to the method, the electrodes material may be Pt, or Mo, or W, or TiN, or Ta.

According to the method, the lateral body conductive layer may be constituted of either Pt, or Mo, or W, or TiN, or Ta.

With reference to FIG. 1, a four terminal nano-electromechanical switch having a single mechanical contact is disclosed, which is of great importance for low power nano-electromechanical switch to reduce the power consumption in the switch.

The nano-electromechanical switch comprises four electrodes: an input (or source) electrode S, an output (or drain) electrode D, an actuator (or gate) electrode G and a body electrode B. As already explained, the fact that the nano-electromechanical switch comprises four terminals, e.g. four electrodes, is of great importance because a four terminal switch enables the control of the switching state (open/close) by a gate-to-body voltage independent of the source (input) and the drain (output) voltages.

Thus, the nano-electromechanical switch according to the invention is provided with a cantilever beam CB that has a layer structure, i.e., at least three layers, with:

a first layer corresponding to the body electrode B;

a second layer corresponding to an insulating layer IL, and a third layer corresponding to the input electrode S.

The three layers form a sequence wherein, on the one hand, the first layer corresponding to the body electrode B is adjacent to the second layer corresponding to the insulating layer IL, and on the other hand, the second layer is adjacent to the third layer corresponding to the input electrode S. The second layer/insulating layer IL consequently separates and insulates the first layer/body electrode B from the third layer/input electrode S.

The nano-electromechanical switch according to the invention further comprises a cantilever beam CB able to flex in response to an actuation voltage applied between the body electrode B and the actuator electrode G in such a way that it moves from an open position PO to a closed position PC. In the closed position PC, the cantilever beam CB makes the input electrode S come in contact with the output electrode D at a single mechanical contact point P.

It must be noted that the first, second and third layers may be but are not necessarily superimposed. Yet, at least three layers are needed because the body electrode B must be insulated from the input electrode S over essentially the whole length of the cantilever beam CB.

Figure 2:
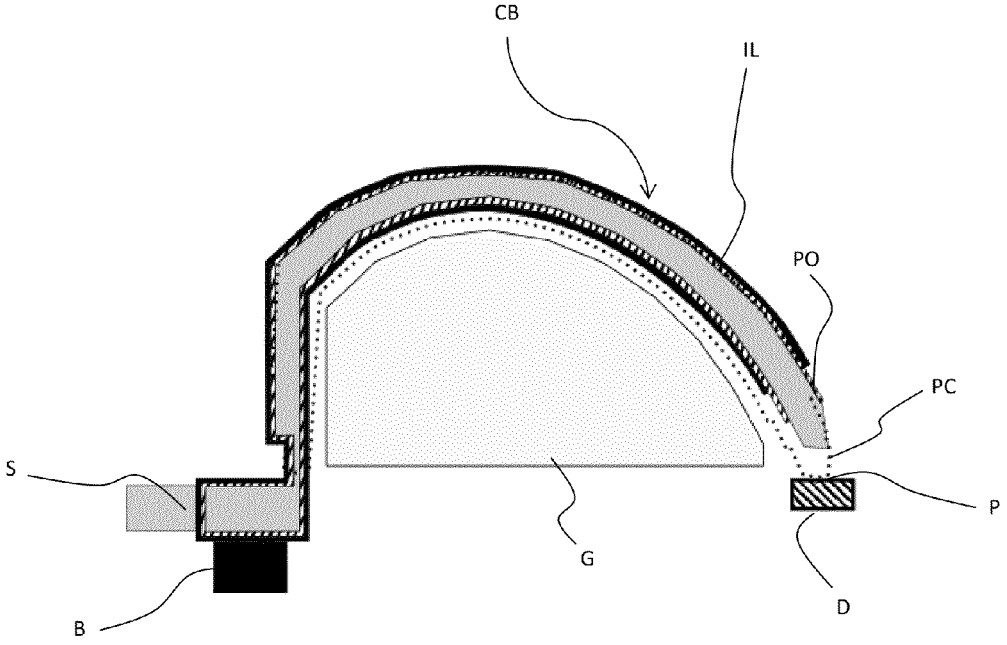
FIG. 2 shows another example of a nano-electromechanical switch according to the invention, with a curved cantilever beam.

FIG. 2 shows another embodiment of the invention in which the cantilever beam CB is curved so that the gap between the input electrode S and the drain electrode D remains as uniform as possible even when the cantilever beam CB is moving. In the same way as for the embodiment presented in FIG. 1, the nano-electromechanical switch shown in FIG. 2 is constructed from three layers with a first layer corresponding to a body electrode B, a second layer corresponding to an insulating layer IL and a third layer corresponding to an input electrode S.

FIG. 3A, FIG. 3B, FIG. 3C and FIG. 3D illustrate different and non-limitative embodiments of the nano-electromechanical switch according to the invention.

Figure 3A:
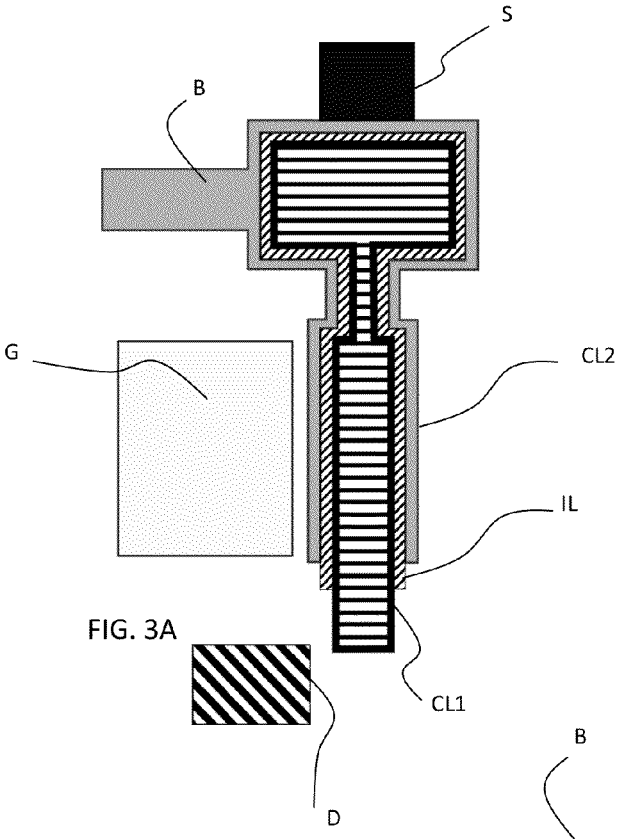
FIGS. 3A, 3B, 3C and 3D show several embodiments of the nano-electromechanical switch according to embodiment of the invention.

In FIG. 3A, the nano-electromechanical switch comprises a body electrode B and an input electrode S separated by an isolating material forming an insulating layer IL while both body and input electrodes B, S are part of the moving part of the switch, e.g. the cantilever beam CB. The input electrode S comprises a lateral source conductive layer CL1 which is uncovered at the level of the end of the cantilever beam CB by etching a lateral body conductive layer CL2, part of the body electrode B, and the insulating layer IL. The contact, at the level of the end of the cantilever beam CB, of the input electrode S with the output electrode D can be as small as possible and is not imposing any limitation on the scalability. The thickness of the lateral source conductive layer CL1 can be adjusted to the application needs while the lateral body conductive layer CL2 only needs to be charged to a given potential and can thus be thin.

Figure 3B:
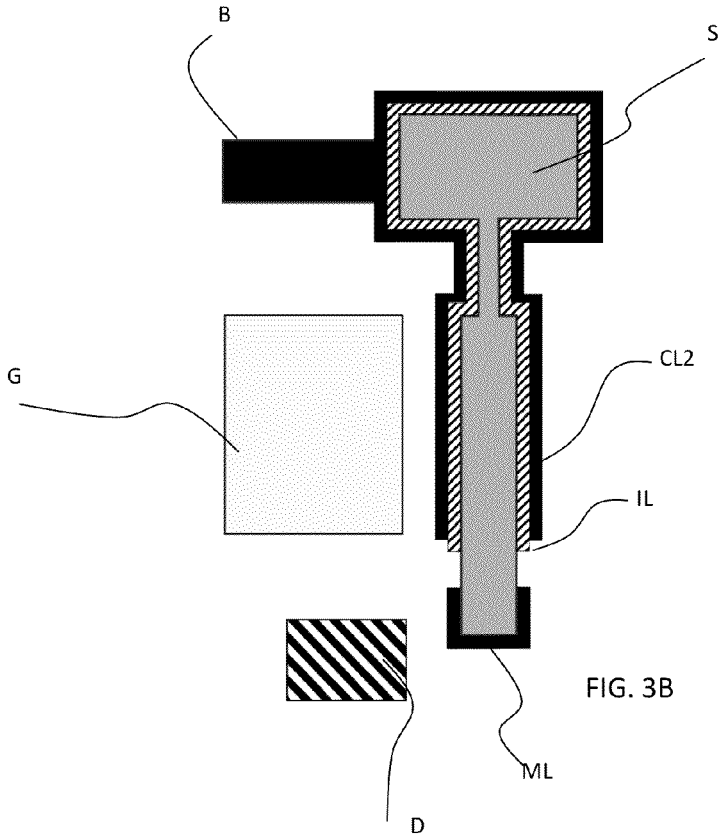

FIG. 3B represents a possible modification of previously described nano-electromechanical switches. In this embodiment, a source current supplying the switch is directly conducted through the material of the cantilever beam CB of the switch. The material may for instance be a doped silicon material, with e.g., a dopant concentration higher than $10^{16}$ atoms per $cm^3$. This simplifies the fabrication process, as only one conductive layer—e.g., lateral body conductive layer CL2—is needed. Further, the cross-section of the conductive cantilever beam CB and of the conductive layer CL2 can be larger, leading to lower series resistance. Depending on the switch material quality, a contact layer ML at the level of the end of the cantilever beam CB, which may be metal or a tunneling barrier, may be relied upon to control the contact resistance and improve the contact reliability, as shown in FIG. 3B. It should be noted that the embodiments of FIG. 3A and FIG. 3B can be combined. Relying on a contact layer ML is often, if not always advantageous, e.g., to tune the contact behavior.

Figure 3C:
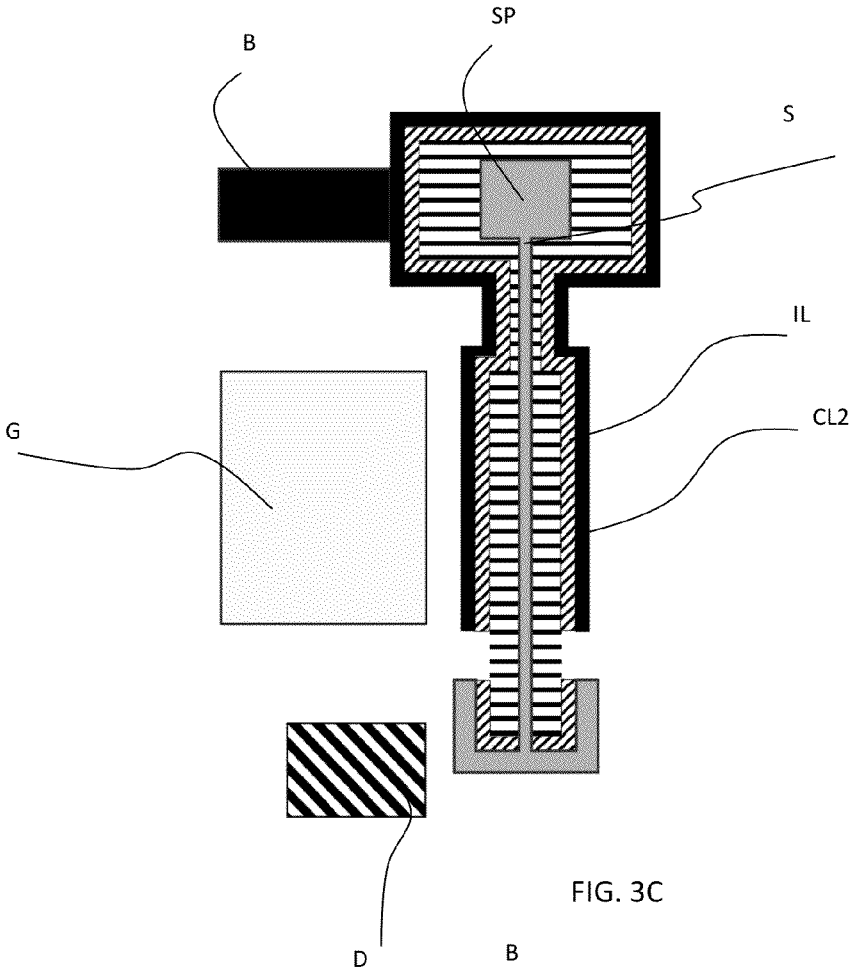

FIG. 3C shows a four terminal nano-electromechanical switch where the input electrode S comprises a source connection plot SP placed on top of the switch, while the body electrode B is routed along a lateral sidewall of the switch. This configuration has the advantage of spatially separating the conduction layer of the input electrode S from the lateral body conductive layer CL2. This is achieved by either using an isolating material or by creating an isolating layer underneath the conduction layer of the input electrode S.

The four terminal nano-electromechanical switch as shown in FIG. 3C has a structural layer of the cantilever beam CB which is covered with the insulating layer IL.

In this embodiment, the first layer corresponding to the body electrode B, the second layer corresponding to the insulating layer IL and the third layer corresponding to the input layer S are adjacent in pairs without being superimposed.

Figure 3D:
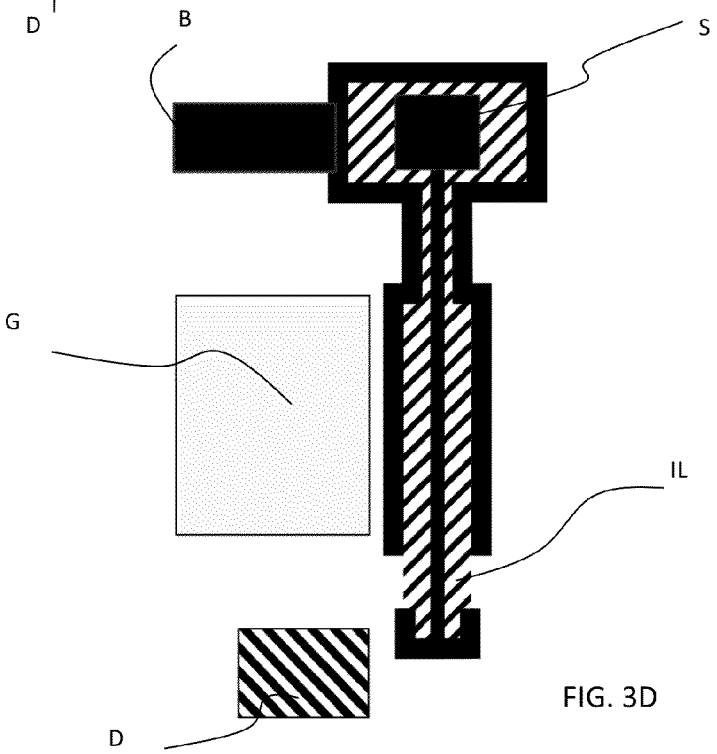

In contrast with the embodiment of FIG. 3C, the four terminal nano-electromechanical switch as shown in FIG. 3D has a structural layer of the cantilever beam CB which is the insulating layer IL itself. In both cases illustrated by FIG. 3C and FIG. 3D, the electrical connections of the nano-electromechanical switch can be formed from a single layer by etching or milling.

It is here recalled that FIG. 1, FIG. 2, and FIGS. 3A, 3B, 3C and 3D illustrate non-limitative embodiments of the nano-electromechanical switch according to the invention.

The invention is also directed to a method for fabricating a nano-electromechanical switch as described above.

One main aspect of the method according to the invention consists in fabricating the cantilever beam CB, the latter comprising the input electrode S, the body electrode B and the insulating layer IL, where the insulating layer IL aims at separating the body electrode B from the input electrode S, which, associated with the actuator electrode G and the output electrode D form a four terminal switch.

The cantilever beam CB is designed in such a manner that it is adapted to flex. Upon flexion thereof, the input electrode S can make contact with the output electrode D at a single mechanical contact point P at the level of the end of the cantilever beam CB, as touched earlier.

The method for fabricating a nano-electromechanical switch according to the invention may provide the cantilever beam CB with a layer structure with at least three layers, being a first layer corresponding to the body electrode B, a second layer corresponding to the insulating layer IL and a third layer corresponding to the input layer S, the insulating layer IL separating the body electrode B from the input electrode S. The fabrication process leading to the layer structure of the cantilever beam CB may not only comprise the deposition of three successive layers corresponding respectively to the first, second and third layers but it might as well consist in a process where two layers are successively deposed and then partially etched at the level of the outermost layer, resulting effectively in a three layer structure.

Thus, the method according to the invention may comprise a step of uncovering the end of the cantilever beam CB, if necessary, in view of uncovering the input electrode S. This latter step corresponds to removing the one or two outermost layer(s) to uncover the input electrode S, which in turn results in making possible contact between the input electrode S and the output electrode D.

It must be noted that the step of uncovering the end of the cantilever beam CB is not always necessary: for instance, in the embodiment shown in FIG. 3C, the intermediate conducting layer is adapted to allow the contact between the input electrode S and the output electrode D.

For instance, a detailed, complete example of a method for fabricating a nano-electromechanical switch as evoked above may comprise the following:

reactive-ion etching, on a silicon on insulator wafer, of a silicon device layer;

deposition of a lateral source conductive layer, e.g. the evaporation of Pt and a rapid thermal annealing to create a PtSi layer on the silicon device layer, corresponding to a lateral source conductive layer;

deposition of an isolation layer, constituted of material such as SiO2 or Si3N4; the deposition may be achieved by Atomic Layer Deposition, or by Chemical Vapor Deposition, or by Plasma Enhanced Chemical Vapor Deposition;

deposition of a lateral body conductive layer, constituted of material such as Pt, or Mo, or W, or TiN, or Ta;

partial removal of the isolation layer and of the lateral source and body conductive layers;

anisotropic reactive-ion etching of the lateral body conductive layer and of the isolation layer to form the body electrode;

isotropic etching of the lateral body conductive layer and of the isolation layer to partially uncover the lateral source conductive layer;

deposition of a sacrificial layer, such as SiO2 or HfO, in view of defining a gap;

deposition of a second sacrificial layer, such as Cu or photo resist, in view of defining a mold for electrode material;

deposition of electrode material, such as Pt, by Physical Vapor Deposition or by plating;

removal of the excessive electrode material and of the mold corresponding to the second sacrificial material;

final etching, by Buffer Oxide Etch, to release the cantilever beam.

To conclude, the present invention is notably directed to a nano-electromechanical switch comprising four electrodes and a cantilever beam, the latter adapted to flex in response to an actuation voltage applied between a body electrode and a gate electrode, the cantilever beam comprising the body electrode, the input electrode, and an insulating layer separating the body electrode from the input electrode. Upon flexion of the cantilever beam, the input electrode born by the cantilever beam comes in contact with the output electrode at a single mechanical contact point situated at the level of the end of the cantilever beam, the single mechanical contact point being of importance to reduce the power consumption in the switch.

The invention claimed is:

1. A nano-electro-mechanical switch, comprising:

a first layer corresponding to a body electrode;

a second layer adjacent to the first layer, the second layer corresponding to an insulating layer;

a third layer adjacent to the second layer, the third layer corresponding to an input electrode, wherein the insulating layer separates and insulates the body electrode from the input electrode;

an actuator electrode;

an output electrode; and a cantilever beam adapted to flex in response to an actuation voltage applied between the body electrode and the actuator electrode, wherein the cantilever beam comprises the input electrode, the body electrode and the insulating layer adjacent a first end of the cantilever beam, the output electrode adjacent a second end of the cantilever beam opposite the first end, and the actuator electrode disposed between the first end and the second end of the cantilever beam, such that, upon flexion of the cantilever beam in response to an actuation voltage applied between the body electrode and the actuator electrode, the input electrode comes in contact with the output electrode at a single mechanical contact point at the level of the second end of the cantilever beam.

2. The nano-electromechanical switch of claim 1, wherein the cantilever beam further comprises a contact layer at the end of the cantilever beam.

* * * * *